US007268495B2

(12) United States Patent
Rintamaki et al.

(10) Patent No.: US 7,268,495 B2
(45) Date of Patent: Sep. 11, 2007

(54) CERAMIC METAL HALIDE LAMP

(75) Inventors: Joshua Ian Rintamaki, Westlake, OH (US); Paul Kuester, Willoughby, OH (US); Andrew Podevels, Cleveland Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/303,107

(22) Filed: Dec. 16, 2005

(65) Prior Publication Data

US 2006/0164016 A1 Jul. 27, 2006

Related U.S. Application Data

(63) Continuation-in-part of application No. 11/040,990, filed on Jan. 21, 2005.

(51) Int. Cl.
*H01J 17/20* (2006.01)

(52) U.S. Cl. ..... 313/640; 313/639

(58) Field of Classification Search ..... 313/571, 313/579, 637, 638, 639, 640, 641, 642
See application file for complete search history.

(56) References Cited

U.S. PATENT DOCUMENTS 3,521,110 A * 7/1970 Johnson ..... 313/571
3,771,009 A 11/1973 Silver
3,786,297 A 1/1974 Zollweg et al.
3,798,487 A 3/1974 Zollweg et al.
4,027,190 A * 5/1977 Shintani et al. ..... 313/639
5,473,226 A 12/1995 Beschle et al.
5,973,453 A 10/1999 VanVliet et al.
6,373,193 B1 4/2002 Marlor
6,469,446 B1 10/2002 Stockwald
6,555,962 B1 4/2003 Jackson et al.
6,583,563 B1 6/2003 Venkataramani et al.

(Continued)

FOREIGN PATENT DOCUMENTS

EP 1134776 9/2001

(Continued)

OTHER PUBLICATIONS

L. N. Yannopoulos, A. Pebler; *Thermochemical Calculations of Tungsten Halogen Lamps Containing Bromine, Oxygen, Hydrogen and Carbon; Journal of Applied Physics*; Feb. 1971; vol. 42, No. 2; Westinghouse Research Laboratories; Pittsburgh, PA;; 15235.

*Primary Examiner*—Vip Patel
(74) *Attorney, Agent, or Firm*—Fay Sharpe LLP

(57) ABSTRACT

A metal halide lamp (10) includes a discharge vessel (12) which may be formed of a ceramic material. The vessel defines an interior space (16). An ionizable fill (17) is disposed in the interior space. The ionizable fill includes an inert gas, mercury, and a halide component. The halide component includes an alkali metal halide, an alkaline earth metal halide component, and optionally at least one of a rare earth halide and a Group IIIA halide. The alkaline earth metal halide component includes at least one of a barium halide and a strontium halide. At least one electrode (18, 20) is positioned within the discharge vessel so as to energize the fill when an electric current is applied thereto. The lamp having a wall loading, when energized, which is sufficient to maintain an active tungsten halogen cycle.

20 Claims, 3 Drawing Sheets

U.S. PATENT DOCUMENTS

| | | | |
|---|---|---|---|
| 6,731,068 | B2 | 5/2004 | Dakin et al. |
| 6,819,050 | B1 | 11/2004 | Zhu et al. |
| 6,956,328 | B1 | 10/2005 | Yu et al. |
| 2003/0015949 | A1 | 1/2003 | Higashi et al. |
| 2003/0020408 | A1 | 1/2003 | Higashi et al. |
| 2003/0025453 | A1 | 2/2003 | Kakisaka et al. |
| 2003/0102808 | A1 | 6/2003 | Dakin et al. |
| 2003/0222595 | A1 | 12/2003 | Chen et al. |
| 2003/0222596 | A1 | 12/2003 | Chen et al. |
| 2004/0189212 | A1 | 9/2004 | Ashida et al. |

FOREIGN PATENT DOCUMENTS

| | | |
|---|---|---|
| WO | PCT/IB02/01583 | 12/1994 |
| WO | PCT/IB99/00541 | 10/1999 |
| WO | PCT/IB02/01583 | 11/2002 |
| WO | PCT/IB2005/050746 | 9/2005 |

* cited by examiner

CERAMIC METAL HALIDE LAMP

This application claims the benefit, as a continuation-in-part, of application Ser. No. 11/040,990, filed Jan. 21, 2005, the disclosure of which is incorporated herein in its entirety by reference.

BACKGROUND OF THE INVENTION

The present invention relates to an electric lamp with high efficiency, good color rendering, and high lamp lumen maintenance. It finds particular application in connection with a ceramic metal halide lamp with halides of barium or strontium in the fill and will be described with particular reference thereto.

Discharge lamps produce light by ionizing a vapor fill material such as a mixture of rare gases, metal halides and mercury with an electric arc passing between two electrodes. The electrodes and the fill material are sealed within a translucent or transparent discharge vessel which maintains the pressure of the energized fill material and allows the emitted light to pass through it. The fill material, also known as a "dose," emits a desired spectral energy distribution in response to being excited by the electric arc. For example, halides provide spectral energy distributions that offer a broad choice of light properties, e.g. color temperatures, color renderings, and luminous efficacies.

Ceramic metal halide lamps have been developed with efficiencies in the range of about 90-100 lumens per watt (LPW), color rendering indices $R_a$ of 85-95, or higher, and lumen maintenance values of 80%, or higher, and color temperatures of between about 2600 and 4000K at wall loadings of from about 20 to 50 W/cm$^2$. However, premature failure of the lamps may occur due to blackening of the discharge vessel walls. The blackening is due to tungsten transferred from the filament to the wall. The presence of oxygen and/or water vapor in the lamp atmosphere has been found to contribute to the wall blackening. Water vapor is particularly harmful because even trace amounts increase the evaporation of the tungsten filament coil by means of the well-known "water cycle." In the water cycle, the temperature of the tungsten coil is thermally sufficient to decompose water vapor into hydrogen and oxygen. The resulting oxygen reacts with the tungsten from the coil to form volatile oxides, which migrate to cool parts of the lamp and condense. These oxide deposits are reduced by the gaseous hydrogen to yield black metallic tungsten and reformed water, which causes the cycle to repeat.

Tungsten halogen lamps, which comprise a hermetically sealed, light transmissive discharge vessel enclosing a tungsten filament and containing a fill comprising a halide or halogen gas are widely used in a variety of applications. Some of these lamps operate on a tungsten halogen cycle which is a regenerative, continuous process in which a halogen-containing tungsten compound is produced when the halide combines chemically with particles of tungsten evaporating from the incandescent tungsten filament. Subsequent thermal decomposition of these so-formed halogen-containing tungsten compounds at the filament returns the tungsten particles back to the filament. Halogen compounds used for the fill include bromine and bromides, such as hydrogen bromide, methyl bromide, dibromomethane, and bromoform. Lamps that operate at low wall loadings (WL), e.g., below about 30 W/cm$^2$, and thus low temperatures, i.e. below about 200° C. interior wall temperatures, generally do not support the tungsten halogen cycle. Additionally, if WL is too low then the halide temperature tends to be too low leading to reduced halide vapor pressure and reduced performance.

It has been proposed to incorporate of a calcium oxide or tungsten oxide dispenser in the discharge vessel, as disclosed, for example in WO 99/53522 and WO 99/53523 to Koninklijke Philips Electronics N.V. U.S. Pat. No. 6,844,676 to Alderman, et al. discloses an arc tube fill comprising metallic mercury, a mixture of noble gases and, optionally, radioactive $^{85}$Kr, and a salt mixture such as a mixture composed of sodium iodide, calcium iodide, thallium iodide, and several rare earth iodides.

The exemplary embodiment provides a new and improved metal halide lamp capable of operating at high or low power which has a high efficiency and good color rendering.

BRIEF DESCRIPTION

In one aspect of the exemplary embodiment, a ceramic metal halide lamp includes a discharge vessel formed of a ceramic material which defines an interior space. An ionizable fill is disposed in the interior space. The ionizable fill includes an inert gas, mercury, and a halide component. The halide component includes an alkali metal halide, an alkaline earth metal halide component, and optionally at least one of a rare earth halide and a Group IIIA halide. The alkaline earth metal halide component includes at least one of a barium halide and a strontium halide. At least one electrode is positioned within the discharge vessel so as to energize the fill when an electric current is applied thereto. The lamp having a wall loading, when energized, which is sufficient to maintain the tungsten halogen cycle.

In another aspect, a ceramic metal halide lamp includes a discharge vessel formed of a ceramic material which defines an interior space. An ionizable fill is disposed in the interior space. The ionizable fill includes an inert gas, mercury, and a halide component. The halide component includes, expressed as mol % of the total halide component of the fill, at least about 5 mol % of sodium halide, optionally, from about 1% to about 10% of a group IIIA metal halide, from about 10% to about 95% of an alkaline earth metal halide, the alkaline earth metal halide comprising at least one of barium halide and strontium halide, and optionally from about 1% to about 15% of a rare earth metal halide. The lamp has a wall loading of at least 30 W/cm$^2$.

In another aspect, a method of operating a lamp includes providing a discharge vessel with an ionizable fill comprising an inert gas, mercury, and a halide component, the halide component comprising, expressed as mol % of the total halide component of the fill, at least about 5 mol % of sodium halide, optionally, from about 1% to about 10% of a group IIIA metal halide, from about 10% to about 95% of an alkaline earth metal halide, the alkaline earth metal halide comprising at least one of barium halide and strontium halide, and optionally from about 1% to about 15% of a rare earth metal halide. The lamp is energized to generate a discharge and provide the discharge vessel with a wall loading of at least 30 W/cm$^2$.

One advantage of at least one embodiment is the provision of a ceramic arctube fill with improved performance and lumen maintenance.

Another advantage of at least one embodiment is in improved maintenance of the tungsten-halogen cycle.

Another advantage of at least one embodiment is in the ability to select color rendering properties of a lamp.

Still further advantages will become apparent to those of ordinary skill in the art upon reading and understanding the following detailed description of the preferred embodiments.

DETAILED DESCRIPTION

A discharge lamp suited to a variety of applications has a high efficiency, good color rendering, and good lamp lumen maintenance. The lamp is provided with a fill which is formulated to maintain the tungsten-halogen cycle while permitting improved color rendering. The fill includes mercury and an alkaline earth metal halide component comprising at least one and in some aspects, a combination of alkaline earth metal halides. The alkaline earth metal halides may be selected from calcium (Ca), barium (Ba), magnesium (Mg) and strontium (Sr) halides. Suitable halides include chlorides, iodides, bromides, and combinations thereof.

In various aspects, the lamp has a wall loading of at least about 30 W/cm$^2$. The wall loading may be at least about 50 W/cm$^2$, and in some embodiments, about 70 W/cm$^2$, or higher. Below about 25-30 W/cm$^2$, the arctube walls tend to be too cool for efficient maintenance of the active tungsten halogen cycle. While the mechanism is not fully understood, it is proposed that the alkaline earth metal halide component, in combination with the wall loading, maintains an active tungsten halogen wall cleaning cycle in which tungsten evaporated from the hot electrode tips is deposited primarily back on cooler parts of the electrodes instead of depositing on inner surfaces of the arctube walls.

Figure 1:
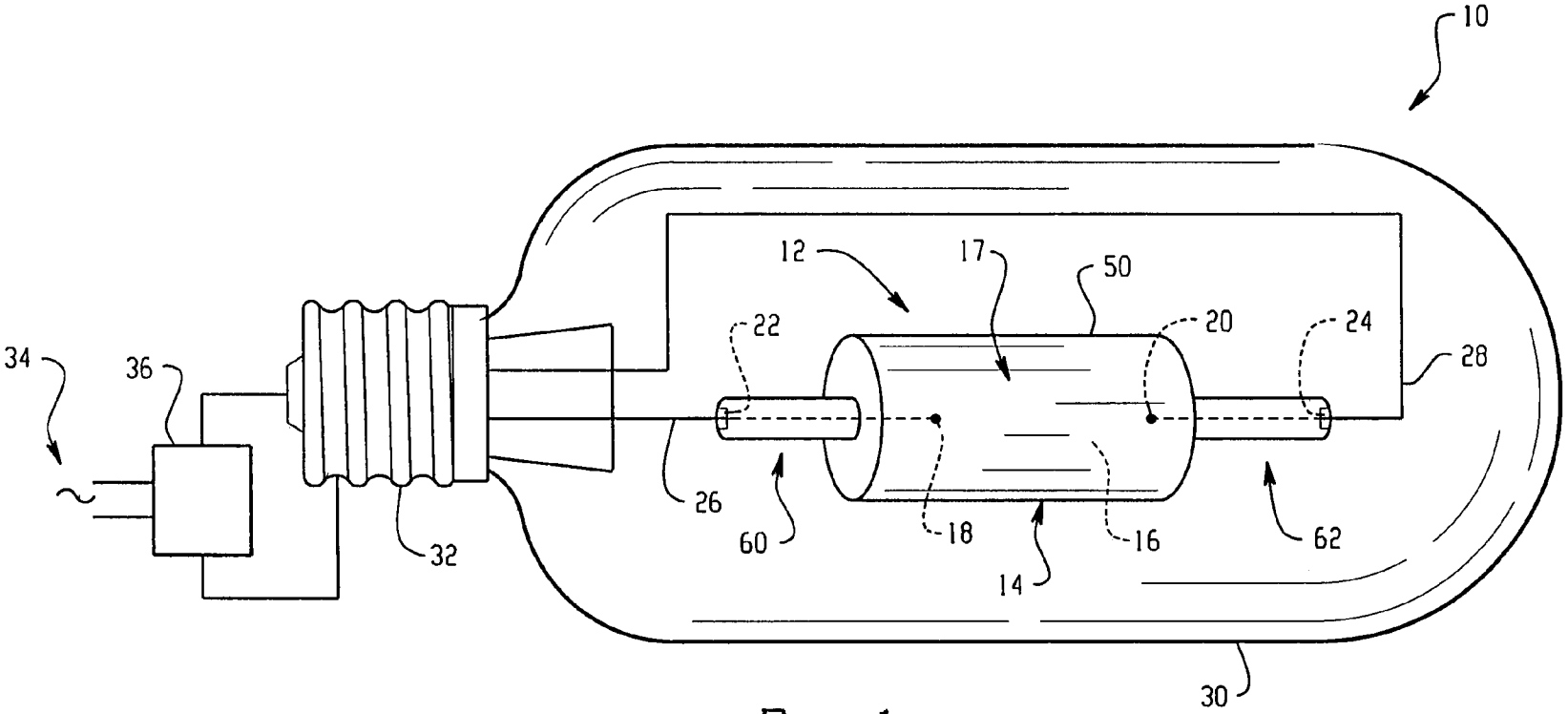
FIG. 1 is a perspective view of a lamp according to the exemplary embodiment.

With reference to FIG. 1, a lighting assembly includes a metal halide discharge lamp 10. The lamp includes a discharge vessel or arctube 12 having a wall 14 formed of a ceramic or other suitable material, which encloses a discharge space 16. The discharge space contains an ionizable fill material 17. Electrodes 18, 20 extend through opposed ends 22, 24 of the arctube and receive current from conductors 26, 28 which supply a potential difference across the arctube and also support the arctube 12. The arctube 12 is surrounded by an outer bulb 30, which is provided with a lamp cap 32 at one end through which the lamp is connected with a source of power 34, such as mains voltage. The lighting assembly also includes a ballast 36, which acts as a starter when the lamp is switched on. The ballast is located in a circuit containing the lamp and the power source. The space between the arctube and outer bulb may be evacuated. Optionally a shroud (not shown) formed from quartz or other suitable material, surrounds or partially surrounds the arctube to contain possible arctube fragments in the event of an arctube rupture.

In operation, the electrodes 18, 20, produce an arc between tips 38, 40 of the electrodes (FIG. 2) which ionizes the fill material to produce a plasma in the discharge space. The emission characteristics of the light produced are dependent, primarily, upon the constituents of the fill material, the voltage across the electrodes, the temperature distribution of the chamber, the pressure in the chamber, and the geometry of the chamber. The electrode tips 38, 40 are spaced by a distance d which defines the arc gap. The ballast 36 is selected to provide sufficient power to the lamp to provide a wall loading of at least about 30 W/cm$^2$.

As defined herein, the arctube wall loading (WL)=W/A where W is the total arctube power in watts and A is the area in cm$^2$ of the arctube wall which is located between the electrode tips 38, 40. For the illustrated lamp of FIG. 2, where the arctube walls are of uniform distance r from the axis X-X of the lamp, $A=2\pi rd$. For more complex designs, where the walls are curved between the electrode tips, as illustrated for example, in FIG. 3, the area can be determined by modeling techniques which take into account the variation in r. The arctube power is the total arctube power including electrode power.

For a ceramic metal halide lamp, the fill material may comprise a mixture of mercury, an inert gas, such as argon, krypton or xenon, and a halide component which includes an alkaline earth metal halide component and may further include one or more alkali metal halides, such as sodium and cesium, one or more halides of a rare earth metal (RE) selected from scandium (Sc), yttrium (Y), lanthanum (La), cerium (Ce, praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu) and/or one or more metal halides selected from Group IIIA of the periodic table of the elements, such as indium (In) and thallium (Tl).

The mercury dose may comprise about 3 to 35 mg/cm$^3$ of arc tube volume, e.g., at least 5 mg/cm$^3$ of arc tube volume and in one embodiment, at least 10 mg/cm$^3$. In one embodiment, the mercury dose is less than about 20 mg/cm$^3$ of arc tube volume. The mercury weight is adjusted to provide the desired arctube operating voltage (Vop) for drawing power from the selected ballast. In an alternative, the lamp filling is mercury-free. The halide dose may comprise from about 10 to about 50 mg/cm$^3$ of arc tube volume, i.e., a ratio of halide dose to mercury of from about 1:3 to about 15:1, expressed by weight.

Typically, the halide element is selected from chlorides, bromides, and iodides. Iodides tend to provide higher lumen maintenance, as corrosion of the arctube is lower than with the comparable bromide or chloride. The halide compounds usually will represent stoichiometric relationships. The alkaline earth metal halide(s) of the fill can have the general form $MX_2$, where M is selected from Ca, Ba, Sr, and Mg and X is selected from Cl, Br, and I. In various aspects, the alkaline earth metal halide component includes at least a barium halide ($BaX_2$). By selection of the alkaline earth metal halide or combination thereof, a color temperature appropriate for the desired use of the lamp can be generated. For example, a lamp which emits white light can readily be formulated by combining two or more of the alkaline earth metal halides, together with other components of the fill. Barium halides, for example, tend to provide a red spectral output while magnesium, calcium, and strontium have primarily green, red and blue, and blue spectral outputs, respectively. In some embodiments, the alkaline earth metal halide component includes $BaX_2$ and one or more of $SrX_2$ and $CaX_2$. In one specific embodiment, the alkaline earth metal halide component includes $BaX_2$ and $SrX_2$.

Exemplary halides include $BaI_2$, $SrI_2$, $CaI_2$, $MgI_2$, NaI, TlI, $DyI_3$, $HoI_3$, $TmI_3$, InI, $CeI_3$, $CeBr_3$, $CaI_2$, and CsI, and combinations thereof. Expressed as mole fractions, the total halide component may comprise from about 5% to about 90% of an alkali metal halide, such as NaX, where X can be a halide or combination thereof, from about 10% to about 95% of alkaline earth metal halide component $MX_2$, from 0% to about 10% of a group IIIA halide, such as Tl halide or In halide, and from 0% to about 15% of a rare earth metal halide. In various aspects, $MX_2$ is at least about 15%, and in one embodiment, $MX_2$ is at least about 18%. In some aspects, $MX_2$ is less than about 35%, and in some embodiments, less than about 30%. In various aspects, the group IIIA halide is a Tl halide. The group IIIA halide can be at least 1% of the total halide component and in some aspects, can be at least 2%. In some aspects, the group IIIA halide is less than about 4%. The rare earth metal halide can be at least 2%, and in some aspects, less than 6% of the total halide component. The alkali metal halide can be at a molar concentration of at least 25% of the total halide component and, in some aspects, is less than about 80%.

In various aspects, the total halide component comprises at least 2% $BaX_2$. In specific embodiments, the halide component comprises at least 4% $BaX_2$. In some aspects, the ratio of $BaX_2$ to other $MX_2$ compounds in the fill can range from about 1:10 to about 10:1.

In one embodiment, the halide component comprises cerium halide, e.g., cerium bromide, which may be present at a molar concentration of at least 4% of the halides in the fill. The sodium halide may be present at a molar percent which is at least twice the molar percent of the cerium halide, e.g., at least about 8 mol % of the halides in the fill.

For example, the halide component of the fill comprises 20-75% $MI_2$, 2-15% $CeI_3$, 1-10% TlI, and the balance (about 25-77%) NaI, either alone or with minor amounts of other halides, is suitable for achieving a good color rendering index (Ra), efficiency, and a color correction temperature (CCT) on an electronic ballast. Such a lamp is designed to have few premature failures in the 100 to 1000 hour range.

In one embodiment, other halides than Na, Ce, Tl, and M are also present at a total of no more than 10% by weight of the total halide component. These other halides may include one or more halides of a rare earth metal (RE) selected from scandium, yttrium, lanthanum, praseodymium, neodymium, promethium, samarium, europium, gadolinium, terbium, dysprosium, holmium, erbium, thulium, ytterbium and lutetium.

$CeI_3$ and TlI contribute to the slightly green appearance of the light, without creating an unpleasant appearance. These may exhibit some instability in the plasma, which can be overcome by the presence of CsI. The lamp may provide a corrected color temperature (CCT) between about 2500K and about 4500K, e.g., between about 3500K and 4500K. The lamp may have a color rendering index, Ra>70, e.g., Ra>70, and in some embodiments, Ra>80. The color rendering index is a measure of the ability of the human eye to distinguish colors by the light of the lamp. The lamp can have a Dccy of about 0.010 to 0.030, e.g., about 0.022. Dccy is the difference in chromaticity of the color point, on the Y axis (CCY), from that of the standard black body curve.

The metal halide arctubes are back filled with an inert gas, to facilitate starting, such as one or more of argon, xenon, and krypton. For the inert gas, xenon has advantages over argon as an ignition gas because the atoms are larger and inhibit evaporation of the tungsten electrodes, so that the lamp lasts longer. In one embodiment, suited to CMH lamps, the lamp is backfilled with Xe with a small addition of Kr85. The radioactive Kr85 provides ionization which helps starting. The cold fill pressure can be about 60-300 Torr. In one embodiment, a cold fill pressure of at least about 120 Torr is used. In another embodiment, the cold fill pressure is up to about 240 Torr. A too high pressure can compromise starting. A too low pressure can lead to increased lumen depreciation over life. In one exemplary embodiment, the fill gas includes at least Ar or Xe, Hg, a trace amount of Kr85, and a halide component.

In one embodiment the lumens per watt (LPW) of the lamp at 100 hours of operation is at least 100, and in one specific embodiment, at least 110. The lumen maintenance, measured as:

$$\frac{\text{Lumens at 8000 hrs}}{\text{Lumens at 100 hrs}},$$

can be at least about 80%, and in one embodiment, at least 85%.

The ceramic metal halide lamp can be of a three part construction, as described in application Ser. No. 11/040,990. The parts are formed as green ceramic and bonded by sintering or other suitable method.

Figure 2:
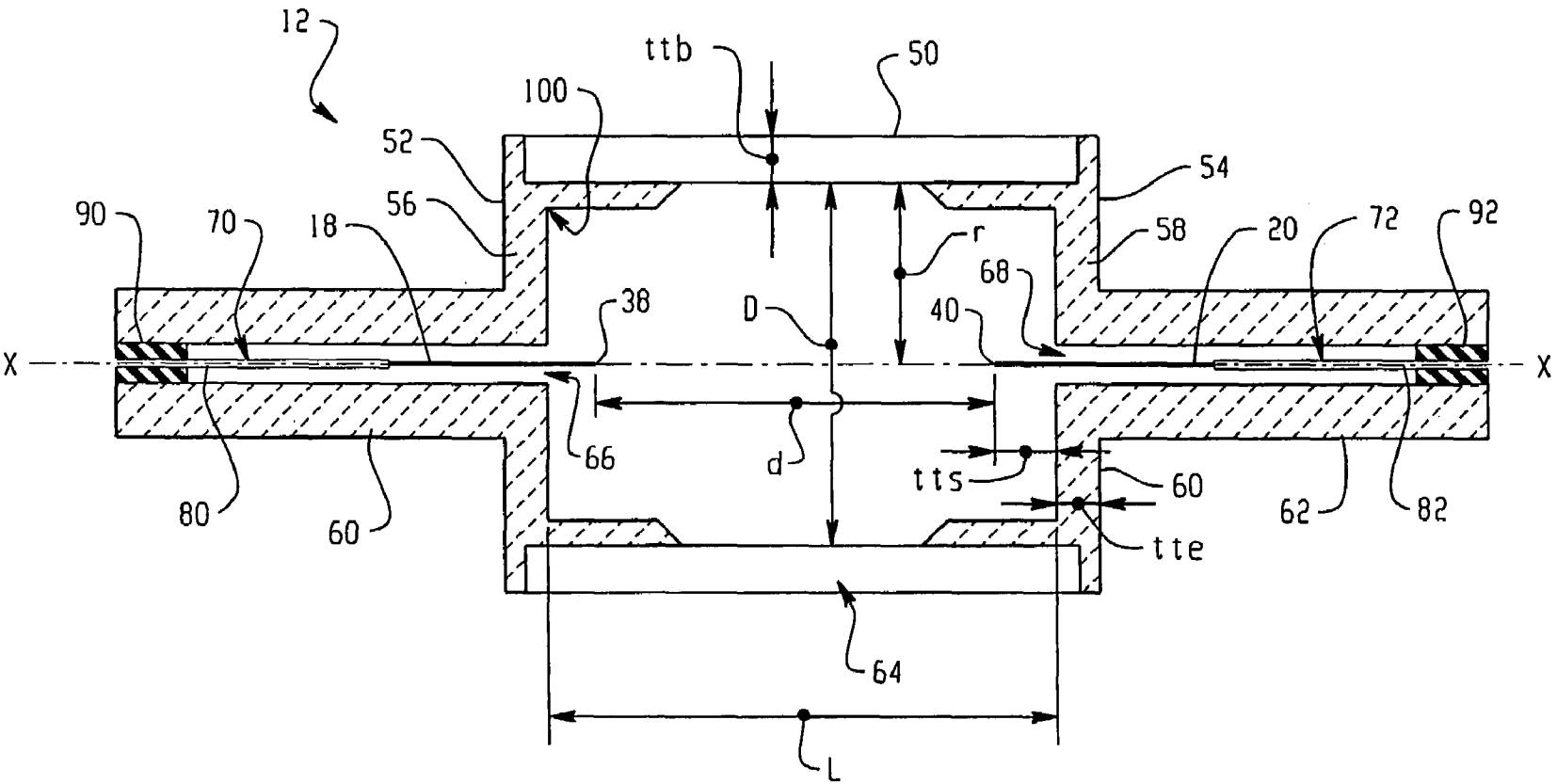
FIG. 2 is a side sectional view of a first embodiment of an arc tube for the lamp of FIG. 1.
Figure 3:
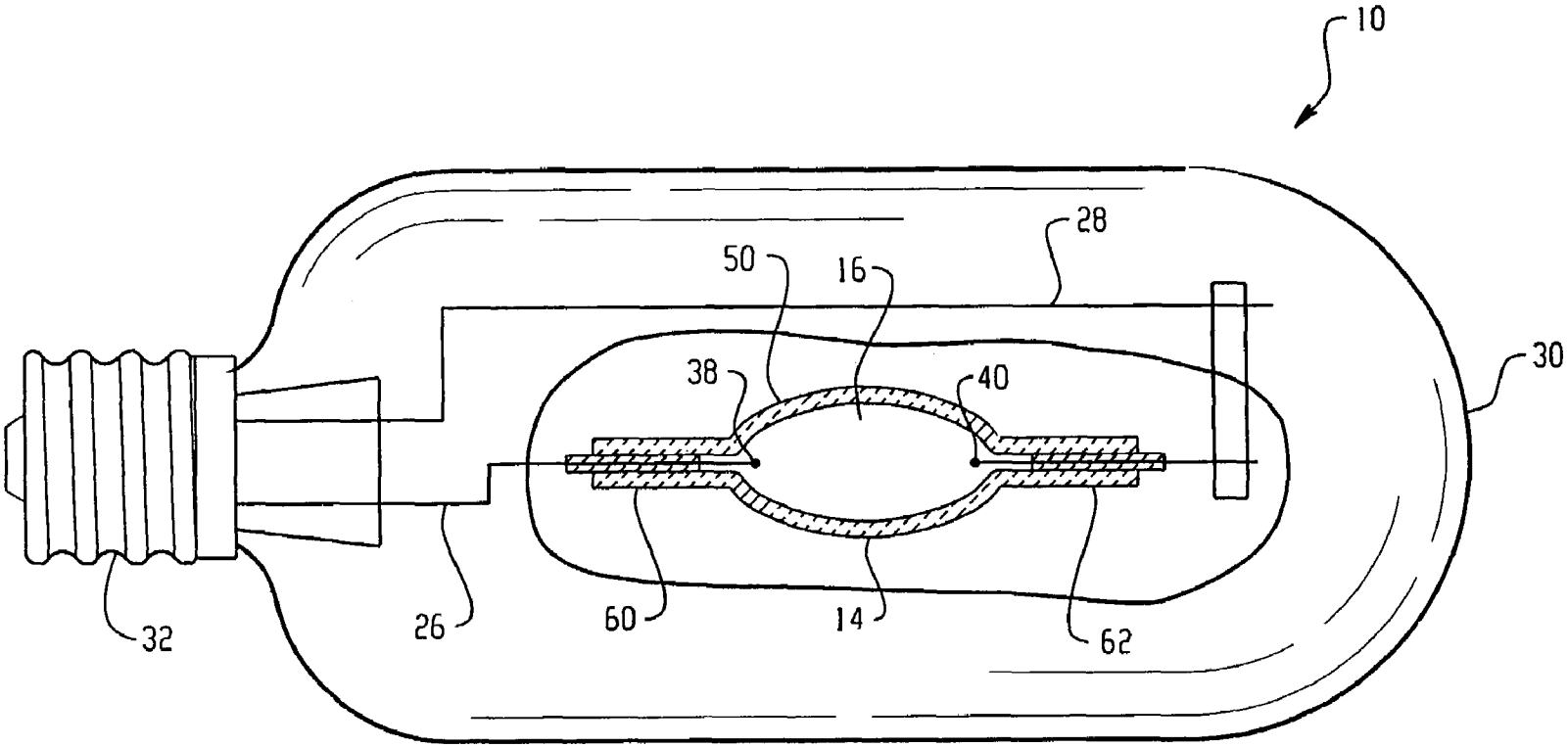
FIG. 3 is side sectional view of a second embodiment of an arc tube for the lamp of FIG. 1.

With particular reference to FIG. 2, the illustrated arctube 12 may include a body portion 50 extending between end portions 52, 54. The body portion of FIG. 2 is cylindrical or substantially cylindrical about a central axis X-X. By "substantially cylindrical" it is meant that the internal radius r of the body portion does not vary by more than 10% within the area between the electrode tips. Alternatively, the body may have a more elliptical shape, as illustrated in FIG. 3. The end portions, in the illustrated embodiment, are each integrally formed and comprise a generally disk-shaped wall portion 56, 58 and an axially extending hollow leg portion 60, 62, through which the respective electrodes 18, 20 are fitted. The leg portions may be cylindrical, as shown, or taper such that the external diameter decreases away from the body portion 50.

The cylindrical wall 50 has an internal diameter D (the maximum diameter, as measured in the region 64 between the electrode tips 38, 40, and a length L. The Aspect Ratio of the lamp (L/D) is defined as the internal arctube length divided by the internal arctube diameter. The ratio L/D can be in the range of about 0.8 to 3.5. In one embodiment, L/D is from about 2.0 to about 3.0, e.g., from 2.2 to 2.8, which is particularly suited to high wattage lamps, e.g., above about 150-200 W. For lower wattage lamps, e.g., those below about 100 W, an L:/D ratio of from about 0.8 to 1.8 may be employed. The L/D ratio can be outside these ranges, particularly if the color temperature is not considered to be of particular importance.

The end portions 52, 54 are fastened in a gas tight manner to the cylindrical wall 50 by means of a sintered joint. The end wall portions each have an opening 66, 68 defined at an interior end of an axial bore 70, 72 through the respective leg portion 60, 62. The bores 70, 72 receive leadwires 80, 82 through seals 90, 92. The electrodes 18, 20, which are electrically connected to the leadwires, and hence to the conductors, typically comprise primarily tungsten and are about 8-10 mm in length. The leadwires 80, 82 typically comprise niobium and molybdenum which have thermal expansion coefficients close to that of alumina to reduce thermally induced stresses on the alumina leg portions and may have halide resistant sleeves formed, for example, of Mo—$Al_2O_3$.

The ceramic wall thickness (ttb) is defined as the thickness (mm) of the wall material in the central portion of the arctube body. ttb, measured in the cylindrical portion 50 can be at least 1 mm in some embodiments, particularly in the case of lamps operating at high wattage. If ttb is too low, then there tends to be inadequate heat spreading in the wall through thermal conduction. This can lead to a hot local hot spot above the convective plume of the arc, which in turn causes cracking as well as a reduced limit on wall loading (WL). A thicker wall spreads the heat, reducing cracking and enabling higher WL. In general, the optimum ttb increases with the size of the arctube; higher wattages benefiting from larger arctubes with thicker walls. In one embodiment, where the arctube power is in the range of 250-400 W, 1.1 mm<ttb<1.5 mm. For lower wattages, e.g., less than about 200 W, the wall thickness ttb can be somewhat lower. If WL is too high then the arctube material may tend to become too hot, leading to softening in the case of quartz, or evaporation in the case of ceramic.

The arc gap d is the distance between tips 38, 40 of the electrodes 18, 20. The distance tts is defined as the distance from the electrode tip to the respective wall 56, 58 defining the internal end of the arctube body. Optimization of tts leads to an end structure hot enough to provide the desired halide pressure, but not too hot to initiate corrosion of the ceramic material. In one embodiment, tts is about 2.9-3.3 mm. In another embodiment, tts~3.1 mm.

The arctube legs 60, 62 provide a thermal transition between the higher ceramic body-end temperatures desirable for arctube performance and the lower temperatures desirable for maintaining the seals 90, 92 at the ends of the legs. The minimum internal diameter of the legs is dependent on the electrode-conductor diameter, which in turn is dependent on the arc current to be supported during starting and continuous operation.

The end wall portions are provided with a thickness tte large enough to spread heat but small enough to prevent or minimize light blockage. Discrete interior corners 100 provide a preferred location for halide condensation.

The illustrated arc tube 12 is formed from three components which are sealed together during sintering. It will be appreciated that the arc tube can be constructed from fewer or greater number of components, such as one or five components. In a five component structure, the plug members are replaced by separate leg and end wall members which are bonded to each other during assembly.

The body member and the plug members can be constructed by die pressing a mixture of a ceramic powder and a binder into a solid cylinder. Typically, the mixture comprises 95-98% by weight ceramic powder and 2-5% by weight organic binder. The ceramic powder may comprise alumina ($Al_2O_3$) having a purity of at least 99.98% and a surface area of about 2-10 $m^2/g$. The alumina powder may be doped with magnesia to inhibit grain growth, for example in an amount equal to 0.03%-0.2%, in one embodiment, 0.05%, by weight of the alumina. Other ceramic materials which may be used include non reactive refractory oxides and oxynitrides such as yttrium oxide, lutetium oxide, and hafnium oxide and their solid solutions and compounds with alumina such as yttrium-aluminum-garnet and aluminum oxynitride. Binders which may be used individually or in combination include organic polymers such as polyols, polyvinyl alcohol, vinyl acetates, acrylates, cellulosics and polyesters.

An exemplary composition which can be used for die pressing a solid cylinder comprises 97% by weight alumina powder having a surface area of 7 $m^2/g$, available from Baikowski International, Charlotte, N.C. as product number CR7. The alumina powder was doped with magnesia in the amount of 0.1% of the weight of the alumina. An exemplary binder includes 2.5% by weight polyvinyl alcohol and ½% by weight Carbowax 600, available from Interstate Chemical.

Subsequent to die pressing, the binder is removed from the green part, typically by thermal pyrolysis, to form a bisque-fired part. The thermal pyrolysis may be conducted, for example, by heating the green part in air from room temperature to a maximum temperature of about 900-1100° C. over 4-8 hours, then holding the maximum temperature for 1-5 hours, and then cooling the part. After thermal pyrolysis, the porosity of the bisque-fired part is typically about 40-50%.

The bisque-fired part is then machined. The machined parts are typically assembled prior to sintering to allow the sintering step to bond the parts together. The parts may be of different densities so that they have different shrinkage properties and thus form a seal on sintering.

The sintering step may be carried out by heating the bisque-fired parts in hydrogen having a dew point of about 10-15° C. Typically, the temperature is increased from room temperature to about 1850-1880° C. in stages, then held at 1850-1880° C. for about 3-5 hours. Finally, the temperature is decreased to room temperature in a cool down period. The inclusion of magnesia in the ceramic powder typically inhibits the grain size from growing larger than 75 microns. The resulting ceramic material comprises a densely sintered polycrystalline alumina. The seals 90, 92 typically comprise a dysprosia-alumina-silica glass and can be formed by placing a glass frit in the shape of a ring around one of the leadwires 80, 82, aligning the arctube 12 vertically, and melting the frit. The melted glass then flows down into the leg 60, 62, forming a seal 90, 92 between the conductor and the leg. The arctube is then turned upside down to seal the other leg after being filled with the fill material.

According to another exemplary method of construction, the component parts of the discharge chamber are formed by injection molding a mixture comprising about 45-60% by volume ceramic material and about 55-40% by volume binder. The ceramic material can comprise an alumina powder having a surface area of about 1.5 to about 10 $m^2/g$, typically between 3-5 $m^2/g$. According to one embodiment, the alumina powder has a purity of at least 99.98%. The alumina powder may be doped with magnesia to inhibit grain growth, for example in an amount equal to 0.03%-0.2%, e.g., 0.05%, by weight of the alumina. The binder may comprise a wax mixture or a polymer mixture.

In the process of injection molding, the mixture of ceramic material and binder is heated to form a high viscosity mixture. The mixture is then injected into a suitably shaped mold and subsequently cooled to form a molded part.

Subsequent to injection molding, the binder is removed from the molded part, typically by thermal treatment, to form a de-bindered part. The thermal treatment may be conducted by heating the molded part in air or a controlled environment, e.g., vacuum, nitrogen, rare gas, to a maximum temperature, and then holding the maximum temperature. For example, the temperature may be slowly increased by about 2-3° C. per hour from room temperature to a temperature of 160° C. Next, the temperature is increased by about 100° C. per hour to a maximum temperature of 900-1100° C. Finally, the temperature is held at 900-1100° C. for about 1-5 hours. The part is subsequently cooled. After the thermal treatment step, the porosity is about 40-50%.

The bisque-fired parts are typically assembled prior to sintering to allow the sintering step to bond the parts together, in a similar manner to that discussed above.

Without intending to limit the scope of the present invention, the following example demonstrates the formation of lamps using ceramic vessels with improved performance.

EXAMPLE

Arctubes are formed according to the shape shown in FIG. 2 from three component parts. The internal diameter D is ~5.8 mm and the internal length L is ~7.6 mm. A fill comprising ~5 mg halide in the weight ratios given in TABLE 1 is used for forming lamps. The metal halide arctubes are back filled with a rare gas, comprising Ar or Xe and a small addition of Kr85. The cold fill pressure is 120-300 Torr. The arctubes are assembled into lamps having an outer vacuum jacket and which are run on 70 W Electronic Ballasts. The arctube leg geometry, leadwire design, seal parameters, and outer jacket are the same for all lamps tested.

Lamps formed as described above are run in a vertical orientation (i.e., as illustrated in FIG. 3) with the lamp cap positioned uppermost at 70 W. TABLE 1 shows the results obtained after 100 hours. CCX and CCY are the chromaticity X and Y, respectively, on a standard CIE chart. The results are the mean of 10-11 lamps.

TABLE 1

| Run | NaI Mol % | Tl Mol % | Alkaline Earth Metal Halide | Alkaline Earth Metal Halide Mol % | Rare Earth Halide | Rare Earth Halide Mol. % |
|---|---|---|---|---|---|---|
| 1 | 70.7 | 2.0 | $CaI_2$ | 24.8 | $CeI_3$ | 2.5 |
| 2 | 67.5 | 3.6 | $CaI_2$ | 24.3 | $CeI_3$ | 4.6 |
| 3 | 67.3 | 2.9 | $CaI_2$ | 26.1 | $CeI_3$ | 3.7 |
| 4 | 75.3 | 2.1 | $BaI_2$ | 19.8 | $CeI_3$ | 2.7 |
| 5 | 74.6 | 2.2 | $BaI_2$ | 20.3 | $DyI_3$ | 3.0 |

TABLE 2

| | | Run | | | | |
|---|---|---|---|---|---|---|
| | | 1 | 2 | 3 | 4 | 5 |
| Watts | Mean | 72 | 72 | 72 | 72 | 72 |
| | STD Dev. | 0 | 0 | 0 | 0 | 0 |
| Lumens | Mean | 6987 | 7633 | 7386 | 6743 | 6144 |
| | STD Dev. | 155 | 262 | 270 | 289 | 306 |
| CCX | Mean | 0.4404 | 0.4133 | 0.4234 | 0.4409 | 0.4460 |
| | STD Dev. | 0.0056 | 0.0099 | 0.0043 | 0.0050 | 0.0112 |
| CCY | Mean | 0.3936 | 0.4094 | 0.4049 | 0.4125 | 0.3893 |
| | STD Dev. | 0.0045 | 0.0032 | 0.0010 | 0.0023 | 0.0083 |
| CCT | Mean | 2857 | 3484 | 3248 | 3004 | 2738 |
| | STD Dev. | 90 | 213 | 85 | 93 | 246 |
| CRI | Mean | 90 | 88 | 88 | 87 | 86 |
| | STD Dev. | 2 | 2 | 2 | 3 | 5 |
| LPW | Mean | 97.0 | 106.0 | 102.6 | 93.6 | 85.3 |
| | STD Dev. | 2.1 | 3.6 | 3.8 | 4.0 | 4.3 |

These results indicate comparable properties for the barium iodide-containing lamps to the calcium iodide lamps, even at a lower mol % in the dose.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A ceramic metal halide lamp comprising:

a discharge vessel formed of a ceramic material which defines an interior space;

an ionizable fill disposed in the interior space, the ionizable fill comprising an inert gas, mercury, and a halide component, the halide component comprising an alkali metal halide, an alkaline earth metal halide component, and optionally at least one of a rare earth halide and a Group IIIA halide, the alkaline earth metal halide component comprising at least one of a barium halide and a strontium halide;

at least one electrode positioned within the discharge vessel so as to energize the fill when an electric current is applied thereto, the lamp having a wall loading, when energized, sufficient to maintain the tungsten halogen cycle.

2. The lamp of claim 1, wherein the alkaline earth metal halide component comprises a barium halide.

3. The lamp of claim 2, wherein the barium halide is at least 2 mol % of a total halide component of the fill.

4. The lamp of claim 2, wherein the barium halide is at least 4 mol % of a total halide component of the fill.

5. The lamp of claim 2, wherein the alkaline earth metal halide component further comprises a strontium halide.

6. The lamp of claim 2, wherein the alkaline earth metal halide component is at least 10 mol % of a total halide component of the fill.

7. The lamp of claim 1, wherein the alkali metal halide is least 5 mol % of the halides in the fill.

8. The lamp of claim 1, wherein the fill comprises the group IIIA halide which includes a thallium halide.

9. The lamp of claim 1, wherein the fill comprises a rare earth halide selected from Sc, Y, La, Ce, Pr, Nd, Pm, Sm, Eu, Gd, Th, Dy, Ho, Er, Tm, Yb, and Lu halides, and combinations thereof.

10. The lamp of claim 9, wherein the rare earth halide comprises a cerium halide.

11. The lamp of claim 1, wherein the rare earth halide comprises at least about 1% of the total halide component of the fill.

12. The lamp of claim 1, wherein the alkaline earth metal halide further comprises a magnesium halide.

13. The lamp of claim 1, wherein the wall loading is at least 30 $W/cm^2$.

14. The lamp of claim 11, wherein the wall loading is at least 50 $W/cm^2$.

15. The lamp of claim 1, wherein the discharge vessel includes a body which is substantially cylindrical.

16. A ceramic metal halide lamp comprising:

a discharge vessel formed of a ceramic material which defines an interior space;

an ionizable fill disposed in the interior space, the ionizable fill comprising an inert gas, mercury, and a halide component, the halide component comprising, expressed as mol % of the total halide component of the fill:

at least about 5 mol % of sodium halide, optionally, from about 1% to about 10% of a group IIIA metal halide, from about 10% to about 95% of an alkaline earth metal halide, the alkaline earth metal halide comprising at least one of barium halide and strontium halide, and optionally, from about 1% to about 15% of a rare earth metal halide; and wherein the lamp has a wall loading of at least 30 $W/cm^2$.

17. The lamp of claim 16, wherein the wall loading is at least 50 $W/cm^2$.

18. The lamp of claim 17, wherein the group IIIA metal halide is at least 1% of the total halide component of the fill.

19. The lamp of claim 16, wherein the barium halide is at least 2% of the total halide component of the fill.

20. A method of operating a lamp comprising;

providing a discharge vessel with an ionizable fill comprising an inert gas, mercury, and a halide component, the halide component comprising, expressed as mol % of the total halide component of the fill:

at least about 5 mol % of sodium halide, optionally, from about 1% to about 10% of a group IIIA metal halide, from about 10% to about 95% of an alkaline earth metal halide, the alkaline earth metal halide comprising at least one of barium halide and strontium halide, and from 0% to about 15% of a rare earth metal halide; and energizing the lamp to generate a discharge and provide the discharge vessel with a wall loading of at least 30 $W/cm^2$.

* * * * *